US008105059B2

(12) United States Patent
Ohtsuka et al.

(10) Patent No.: US 8,105,059 B2
(45) Date of Patent: Jan. 31, 2012

(54) COMPRESSOR WITH SCREW ROTOR AND GATE ROTOR WITH INCLINED GATE ROTOR CENTER AXIS

(75) Inventors: Kaname Ohtsuka, Sakai (JP); Takanori Murono, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 316 days.

(21) Appl. No.: 12/515,517

(22) PCT Filed: Nov. 7, 2007

(86) PCT No.: PCT/JP2007/071623

§ 371 (c)(1),
(2), (4) Date: May 19, 2009

(87) PCT Pub. No.: WO2008/062672

PCT Pub. Date: May 29, 2008

(65) Prior Publication Data

US 2010/0074785 A1 Mar. 25, 2010

(30) Foreign Application Priority Data

Nov. 24, 2006 (JP) ..... 2006-316793

(51) Int. Cl.
*F03C 4/00* (2006.01)
*F04C 2/00* (2006.01)
*F04C 18/00* (2006.01)

(52) U.S. Cl. ..... 418/195; 418/104; 418/116

(58) Field of Classification Search ..... 418/195, 418/104, 116, 150
See application file for complete search history.

(56) References Cited

U.S. PATENT DOCUMENTS

| | | | | |
|---|---|---|---|---|
| 1,989,552 | A | 1/1935 | Good | |
| 3,632,239 | A * | 1/1972 | Zimmern | 418/195 |
| 3,932,077 | A * | 1/1976 | Zimmern | 418/195 |
| 4,179,250 | A * | 12/1979 | Patel | 418/195 |
| 4,321,022 | A * | 3/1982 | Zimmern | 418/195 |
| 4,900,239 | A | 2/1990 | Zimmern | |
| 6,398,532 | B1 * | 6/2002 | Zha et al. | 418/195 |

FOREIGN PATENT DOCUMENTS

| | | |
|---|---|---|
| JP | 49-121207 A | 11/1974 |
| JP | 02-005778 A | 1/1990 |

* cited by examiner

*Primary Examiner* — Theresa Trieu
(74) *Attorney, Agent, or Firm* — Global IP Counselors

(57) ABSTRACT

A compressor includes a screw rotor and a gate rotor arranged to form a compression chamber. The screw rotor has an outer circumferential surface with at least one groove portion. The gate rotor has a plurality of tooth portions. Preferably, a first plane contains the screw rotor center axis, a second plane orthogonally intersects the screw rotor center axis, and a third plane orthogonally intersects the first plane and the second plane. The gate rotor center axis passes through an intersection point of the first, second and third planes. The gate rotor center axis is inclined relative to the second plane toward the same side as the groove portions of the screw rotor, as viewed in a direction perpendicular to the third plane.

2 Claims, 10 Drawing Sheets

COMPRESSOR WITH SCREW ROTOR AND GATE ROTOR WITH INCLINED GATE ROTOR CENTER AXIS

CROSS-REFERENCE TO RELATED APPLICATIONS

This U.S. National stage application claims priority under 35 U.S.C. §119(a) to Japanese Patent Application No. 2006-316793, filed in Japan on Nov. 24, 2006, the entire contents of which are hereby incorporated herein by reference.

TECHNICAL FIELD

The present invention relates to a compressor to be used in, for example, air conditioners, refrigerators and the like.

BACKGROUND ART

Conventionally, there has been a compressor including a cylindrical-shaped screw rotor which rotates about a center axis and which has in its outer circumferential surface at least one groove portion extending spirally about the center axis, and gate rotors which rotate about a center axis and which have a plurality of tooth portions arrayed circumferentially on its outer circumference, the groove portion of the screw rotor and the tooth portions of the gate rotors being engaged with each other to form a compression chamber (see JP 2-5778 A).

That is, this compressor is a so-called CP-type single screw compressor. The term 'CP-type' means that the screw rotor is formed into a cylinder-like shape while the gate rotors are formed into a plate-like shape.

Then, the gate rotor center axis is parallel to a plane orthogonally intersecting with the screw rotor center axis. That is, the tooth portions of the gate rotor are engaged with the groove portion of the screw rotor along the screw rotor center axis.

With a view to preventing interferences between the screw rotor and the gate rotor, side faces of the gate rotor tooth portions are given a maximum angle and a minimum angle each of which is formed by a gate rotor tooth-portion side face and a screw rotor groove wall surface on a plane which orthogonally intersects with the gate rotor plane and which contains a rotational direction of a tooth center line of the gate rotor (hereinafter, angles given by the maximum angle and the minimum angle will be referred to as edge angles of the gate rotor; see edge angles δ1, δ2 of FIG. 13).

SUMMARY OF INVENTION

Technical Problem

However, with the conventional compressor described above, since the gate rotor center axis is parallel to a plane orthogonally intersecting with the screw rotor center axis, angles formed by side faces of the screw rotor groove against side faces of the gate rotor tooth portions on the plane orthogonally intersecting with the gate rotor plane and containing the rotational direction of the gate rotor tooth center line involves a larger difference between a maximum value and a minimum value.

As a result of this, edge angles of gate rotor seal portions to be engaged with the side faces of the screw rotor groove portion become acute, so that a blow holes (leak clearance) present at an engagement portion between the screw rotor groove portion and the gate rotor tooth portion becomes larger. This would result in a lowered compression efficiency.

Accordingly, an object of the present invention is to provide a compressor in which the blow hole is made smaller so as to improve the compression efficiency.

Solution to Problem

In order to achieve the above object, in the present invention, there is provided a compressor comprising:

a cylindrical-shaped screw rotor which rotates about a center axis and which has in its outer circumferential surface at least one groove portion extending spirally about the center axis; and a gate rotor which rotates about a center axis and which has a plurality of tooth portions arrayed circumferentially on its outer circumference, the groove portion of the screw rotor and the tooth portions of the gate rotor being engaged with each other to form a compression chamber, wherein a variation width of an inclination angle at which a side face of the groove portion of the screw rotor to be in contact with the tooth portions of the gate rotor is inclined against a circumferential direction of the gate rotor, the variation being over a range from one axial end to the other end of the screw rotor, is made smaller than a variation width resulting when the gate rotor center axis is parallel to a plane orthogonally intersecting with the screw rotor center axis.

With such a compressor, the variation width of the inclination angle at which the side face of the groove portion of the screw rotor to be in contact with the tooth portions of the gate rotor is inclined against the circumferential direction of the gate rotor, the variation being over a range ranging from axial one end to the other end of the screw rotor, is made smaller than the variation width resulting when the gate rotor center axis is parallel to a plane orthogonally intersecting with the screw rotor center axis. Therefore, edge angles of the seal portions of the gate rotor to be engaged with side faces of the groove portion of the screw rotor can be made obtuse, so that the blow holes (leak clearances) present at engagement portions between the groove portion of the screw rotor and the tooth portions of the gate rotor can be made smaller, so that the compression efficiency can be improved. Besides, wear of the seal portions of the gate rotor can be reduced, allowing an improvement in durability to be achieved.

Also in the present invention, there is provided a compressor comprising:

a cylindrical-shaped screw rotor which rotates about a center axis and which has in its outer circumferential surface at least one groove portion extending spirally about the center axis; and a gate rotor which rotates about a center axis and which has a plurality of tooth portions arrayed circumferentially on its outer circumference, the groove portion of the screw rotor and the tooth portions of the gate rotor being engaged with each other to form a compression chamber, wherein with respect to a first plane containing the screw rotor center axis, a second plane which intersects orthogonally with the screw rotor center axis and which further intersects with the groove portion of the screw rotor, and a third plane which intersects orthogonally with the first plane and the second plane and which is separate from the groove portion of the screw rotor, the gate rotor center axis passes through an intersection point among the first plane, the second plane and the third plane and moreover is inclined against the second plane toward a same side as the groove portion of the screw rotor, as viewed in a direction perpendicular to the third plane.

It is to be noted here that the wording, "inclined toward the same side," means that an inclination of the groove portion of the screw rotor against the second plane, and an inclination of the gate rotor center axis against the second plane, are toward the same side against the second plane, as viewed in a direction perpendicular to the third plane.

With such a compressor, since the gate rotor center axis passes through an intersection point among the first plane, the second plane and the third plane and moreover is inclined against the second plane toward the same side as the groove portion of the screw rotor, as viewed in a direction perpendicular to the third plane, the side face of the groove portion of the screw rotor to be in contact with the tooth portions of the gate rotor can be set at approximately 90° against the rotational direction of the gate rotor (i.e. circumferential direction of the gate rotor) in its portion to be in contact with the side face of the groove portions of the screw rotor. Thus, the variation width of an angle formed by the side face of the groove portion of the screw rotor (hereinafter, referred to as screw rotor groove inclination angle) against a plane orthogonally intersecting with the rotational direction of the gate rotor (the circumferential direction of the gate rotor) can be made smaller.

Therefore, edge angles of the seal portions of the gate rotor to be engaged with side faces of the groove portion of the screw rotor can be made obtuse, so that the blow holes (leak clearances) present at engagement portions between the groove portion of the screw rotor and the tooth portions of the gate rotor can be made smaller, so that the compression efficiency can be improved. Besides, wear of the seal portions of the gate rotor can be reduced, allowing an improvement in durability to be achieved.

In accordance with one aspect of the present invention, the gate rotor center axis is inclined by 5° to 30° against the second plane, as viewed in a direction perpendicular to the third plane.

With such a compressor in accordance with this aspect of the present invention, since the gate rotor center axis is inclined by 5° to 30° against the second plane, as viewed in a direction perpendicular to the third plane, the variation width of the screw rotor groove inclination angle can be made even smaller.

In accordance with one aspect of the present invention, seal portions of the tooth portions of the gate rotor to be in contact with the groove portion of the screw rotor are formed into a curved-surface shape.

With such a compressor in accordance with this aspect of the present invention, the seal portions of the tooth portions of the gate rotor to be in contact with the groove portion of the screw rotor are formed into a curved-surface shape, leakage of the compressed fluid from engagement portions between the tooth portions of the gate rotor and the groove portion of the screw rotor can be reduced, so that the compression efficiency can be improved. Besides, wear resistance of the engagement portions between the tooth portions of the gate rotor and the groove portion of the screw rotor can be improved.

Advantageous Effects of Invention

With a compressor in accordance with one or more of the above aspects of the present invention, the variation width of the inclination angle at which the side face of the groove portion of the screw rotor to be in contact with the tooth portions of the gate rotor is inclined against the circumferential direction of the gate rotor, the variation being over a range ranging from axial one end to the other end of the screw rotor, is made smaller than the variation width resulting when the gate rotor center axis is parallel to a plane orthogonally intersecting with the screw rotor center axis, so that the blow holes can be made smaller and the compression efficiency can be improved.

Also, with a compressor in accordance with one or more of the above aspects of the present invention, since the gate rotor center axis passes through an intersection point among the first plane, the second plane and the third plane and moreover is inclined against the second plane toward the same side as the groove portion of the screw rotor, as viewed in a direction perpendicular to the third plane, the blow holes can be made smaller and the compression efficiency can be improved.

DESCRIPTION OF EMBODIMENTS

Hereinbelow, the present invention will be described in detail by way of embodiments thereof illustrated in the accompanying drawings.

Figure 1:
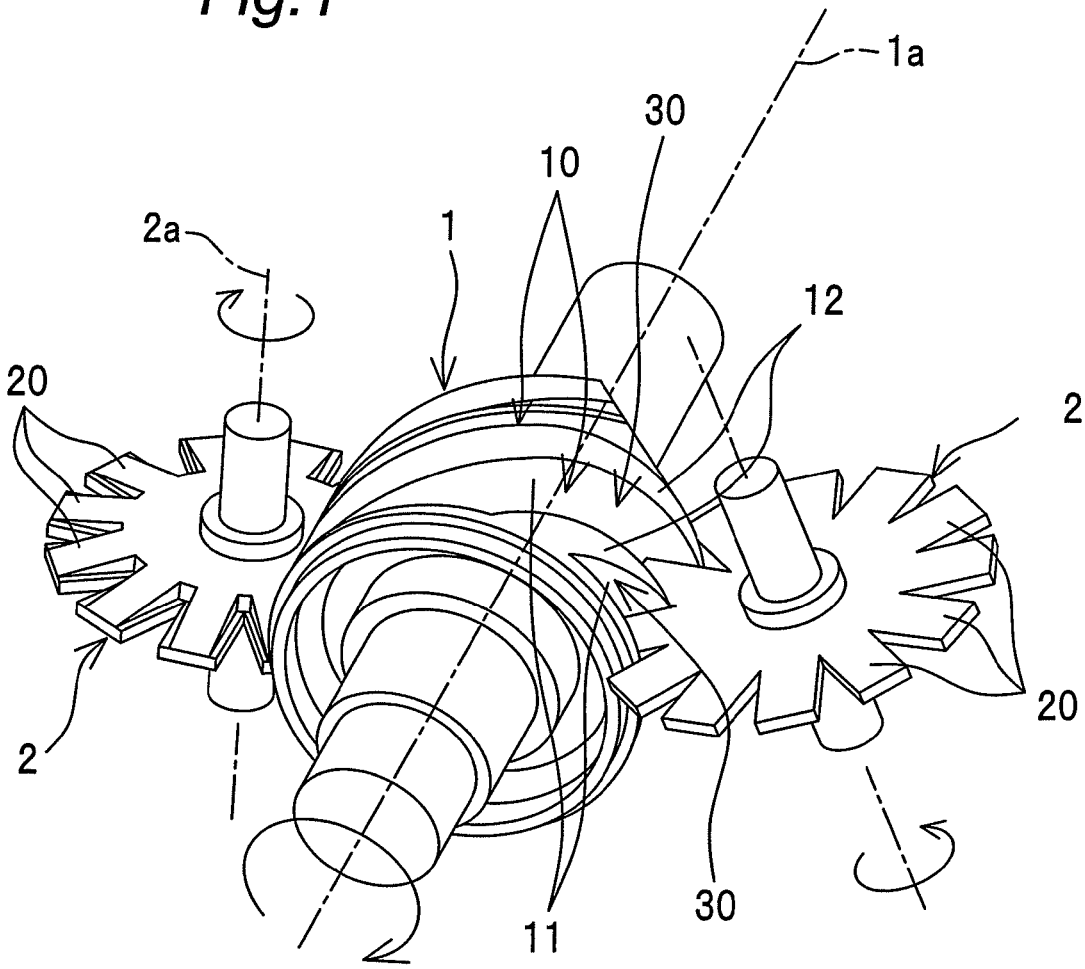
FIG. 1 is a simplified structural view showing an embodiment of the compressor of the invention.

FIG. 1 shows a simplified structural view which is an embodiment of the compressor of the invention. As shown in FIG. 1, the compressor includes: a cylindrical-shaped screw rotor 1 which rotates about a center axis 1*a* and which has in its outer circumferential surface at least one or more groove portions 10 extending spirally about the center axis 1*a*; and a disc-shaped gate rotor 2 which rotates about a center axis 2*a* and which has a plurality of tooth portions 20 arrayed circumferentially on its outer circumference, the groove portions 10 of the screw rotor 1 and the tooth portions 20 of the gate rotor 2 being engaged with each other to form a compression chamber 30.

That is, this compressor is a so-called CP-type single screw compressor. The term 'CP-type' means that the screw rotor 1 is formed into a cylinder-like shape while the gate rotor 2 is formed into a plate-like shape. This compressor is to be used in, for example, air conditioners, refrigerators and the like.

The gate rotor 2 is provided two in number on both sides of the screw rotor 1 so as to be centered on the screw rotor center axis 1*a*. Then, as the screw rotor 1 rotates about the screw rotor center axis 1*a* along a direction indicated by an arrow, each gate rotor 2 subordinately rotates about the gate rotor center axis 2*a* along an arrow direction by mutual engagement of the groove portions 10 and the tooth portions 20.

On the outer circumferential surface of the screw rotor 1 are provided at least one or more thread ridges 12 extending spirally about the screw rotor center axis 1*a*, where the groove portions 10 are formed between neighboring ones of the thread ridges 12, 12. With one of the tooth portions 20 engaged with one of the groove portions 10, side faces (i.e. seal portions) of the tooth portion 20 come into contact with side faces 11 of the groove portion 10 to seal the compression chamber 30, while the tooth portion 20 is rotated by the side faces 11 of the groove portion 10.

On the outer circumferential surface of the screw rotor 1 is attached a casing (not shown) which has slits that allow the gate rotors 2 to rotate. A space closed by the groove portion 10, the tooth portion 20 and the casing serves as the compression chamber 30.

In the casing is provided a suction port (not shown) communicating with the groove portions 10 on one axial end-face side of the screw rotor 1. In the casing is also provided a discharge port (not shown) communicating with the groove portions 10 on the other axial end-face side of the screw rotor 1.

Referring to action of the compressor, a fluid such as refrigerant gas introduced to the groove portion 10 through the suction port is compressed in the compression chamber 30 as the capacity of the compression chamber 30 is reduced by rotation of the screw rotor 1 and the gate rotor 2. Then, the compressed fluid is discharged through the discharge port.

Figure 2:
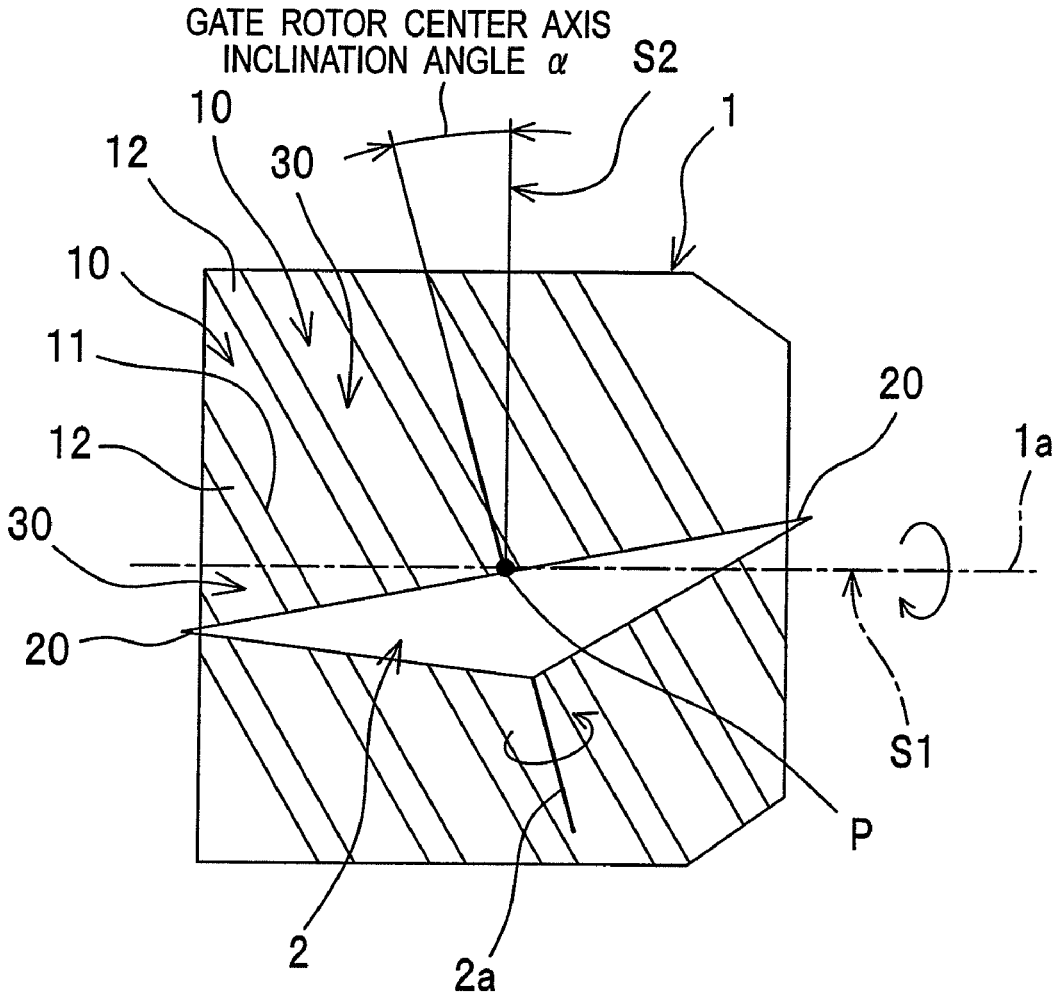
FIG. 2 is a simplified front view of the compressor.

As shown in the simplified front view of FIG. 2, there are defined a first plane S1 containing the screw rotor center axis 1*a*, a second plane S2 which intersects orthogonally with the screw rotor center axis 1*a* and which further intersects with the groove portions 10 of the screw rotor 1, and a third plane S3 (see FIG. 4) which intersects orthogonally with the first plane S1 and the second plane S2 and which is separate from the groove portions 10 of the screw rotor 1.

The gate rotor center axis 2*a* is on the third plane S3 and passes through an intersection point P among the first plane S1, the second plane S2 and the third plane S3.

As viewed in a direction perpendicular to the third plane S3, the gate rotor center axis 2*a* is inclined against the second plane S2 toward the same side as the groove portions 10 of the screw rotor 1. An inclination angle α of the gate rotor center axis 2*a* against the second plane S2 is, preferably, 5° to 30°.

It is to be noted here that the wording, "inclined toward the same side," means that an inclination of the groove portion 10 of the screw rotor 1 against the second plane S2, and an inclination of the gate rotor center axis 2*a* against the second plane S2, are toward the same side against the second plane S2, as viewed in a direction perpendicular to the third plane S3.

Figure 3:
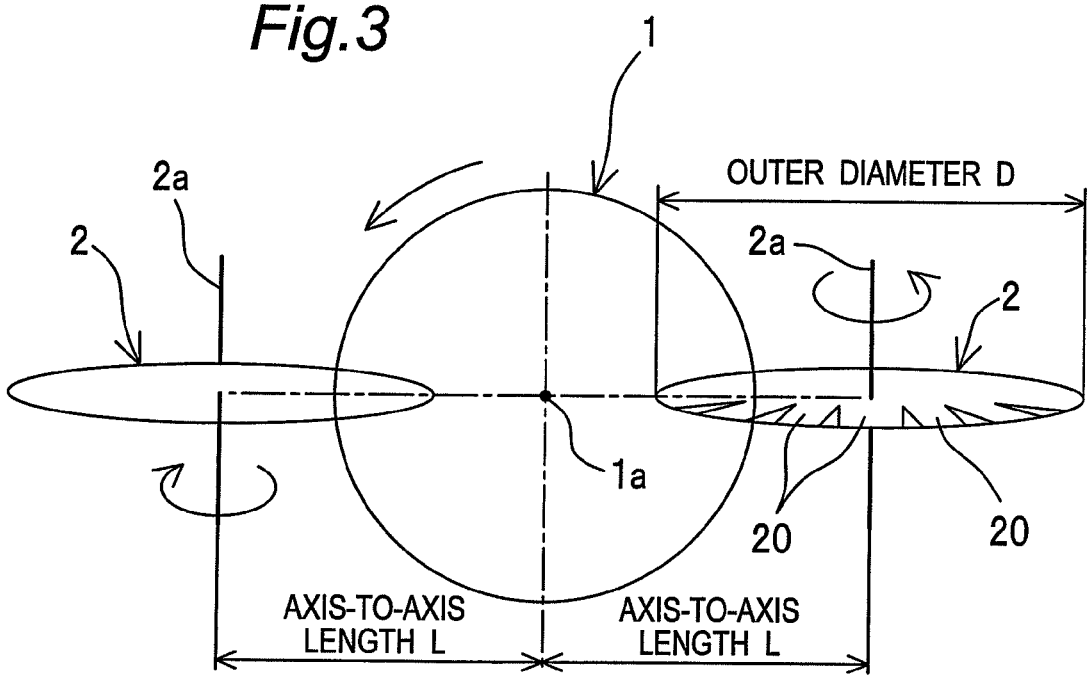
FIG. 3 is a simplified side view of the compressor.

As shown in the simplified side view of FIG. 3, a length L between the gate rotor center axis 2*a* and the screw rotor center axis 1*a* (hereinafter, referred to as axis-to-axis length L) is, for example, 0.7 to 1.2 as long as an outer diameter D of the gate rotor 2 ($0.7D \leqq L \leqq 1.2D$).

Figure 4:
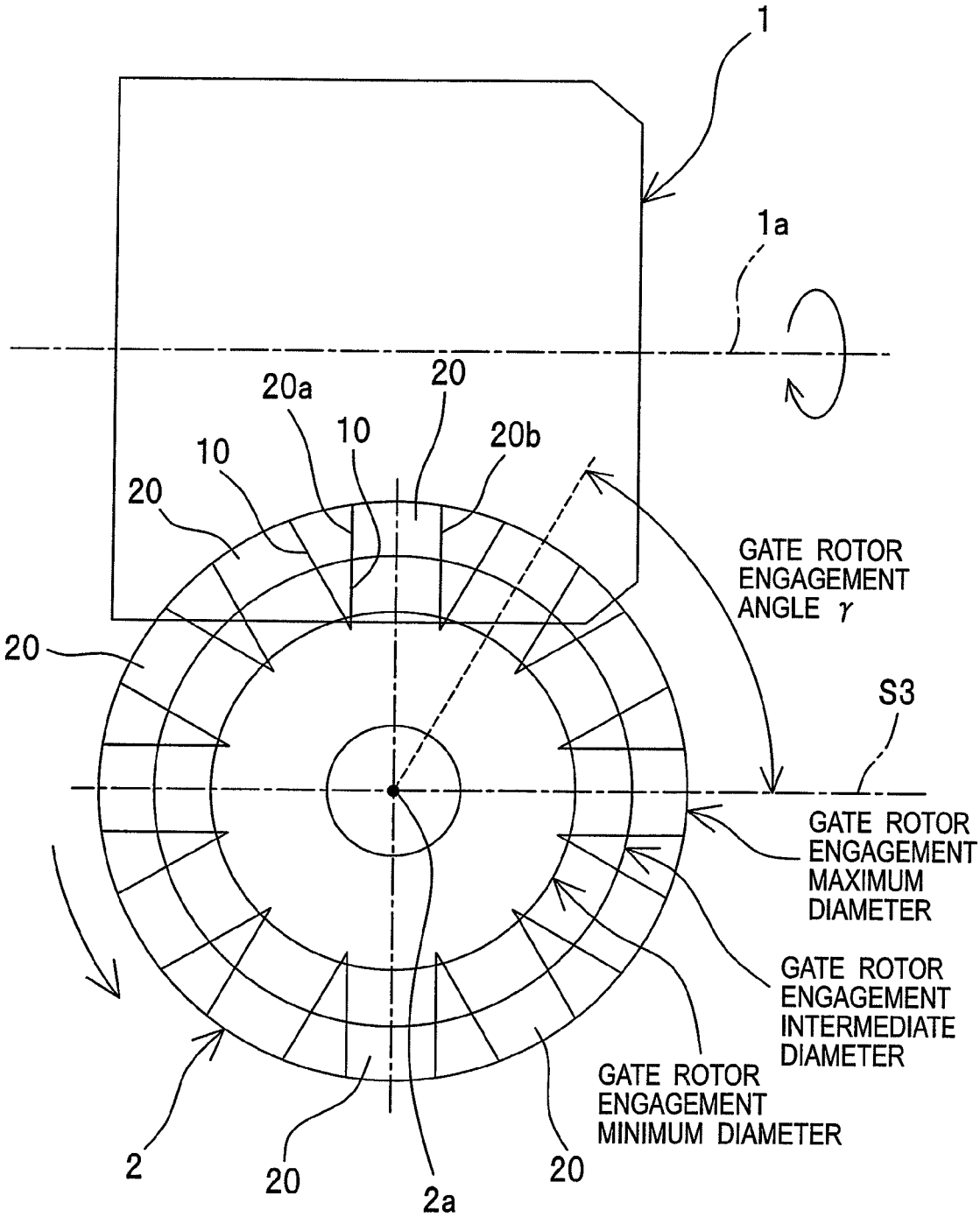
FIG. 4 is an enlarged plan view of the compressor.

As shown in the enlarged plan view of FIG. 4, in a plane which orthogonally intersecting with the gate rotor center axis 2*a* and which contains all the tooth portions 20, an angle that a center line of the tooth portion 20 engaged with the groove portion 10 forms against a reference line parallel to the screw rotor center axis 1*a* is referred to as a gate rotor engagement angle γ, which is measured from the engagement starting side of the gate rotor 2.

FIG. 4 shows, in the tooth portions 20 of the gate rotor 2, an engagement minimum diameter, an intermediate diameter and a maximum diameter of the gate rotor 2, the engagement being done with the groove portions 10 of the screw rotor 1. Also in a tooth portion 20, a side face on the downstream side of the rotational direction of the gate rotor 2 is assumed as a leading-side side face 20*a* while a side face on the upstream side of the rotational direction of the gate rotor 2 is assumed as an unleading-side side face 20*b*.

Next, FIGS. 5 to 8 show relationships between the gate rotor engagement angle γ (see FIG. 4) and the screw rotor groove inclination angle β when the inclination angle α of the gate rotor center axis 2*a* (see FIG. 2) is changed as 0°, 2.5°, 5° and 7.5°, plotting those concerning engagement maximum diameters and intermediate diameters (see FIG. 4) of the gate rotor 2 with respect to the leading-side side face 20*a* and the unleading-side side face 20*b* (see FIG. 4), respectively. The number of the groove portions 10 of the screw rotor 1 is three, and the number of the tooth portions 20 of the gate rotor 2 is twelve.

Figure 13:
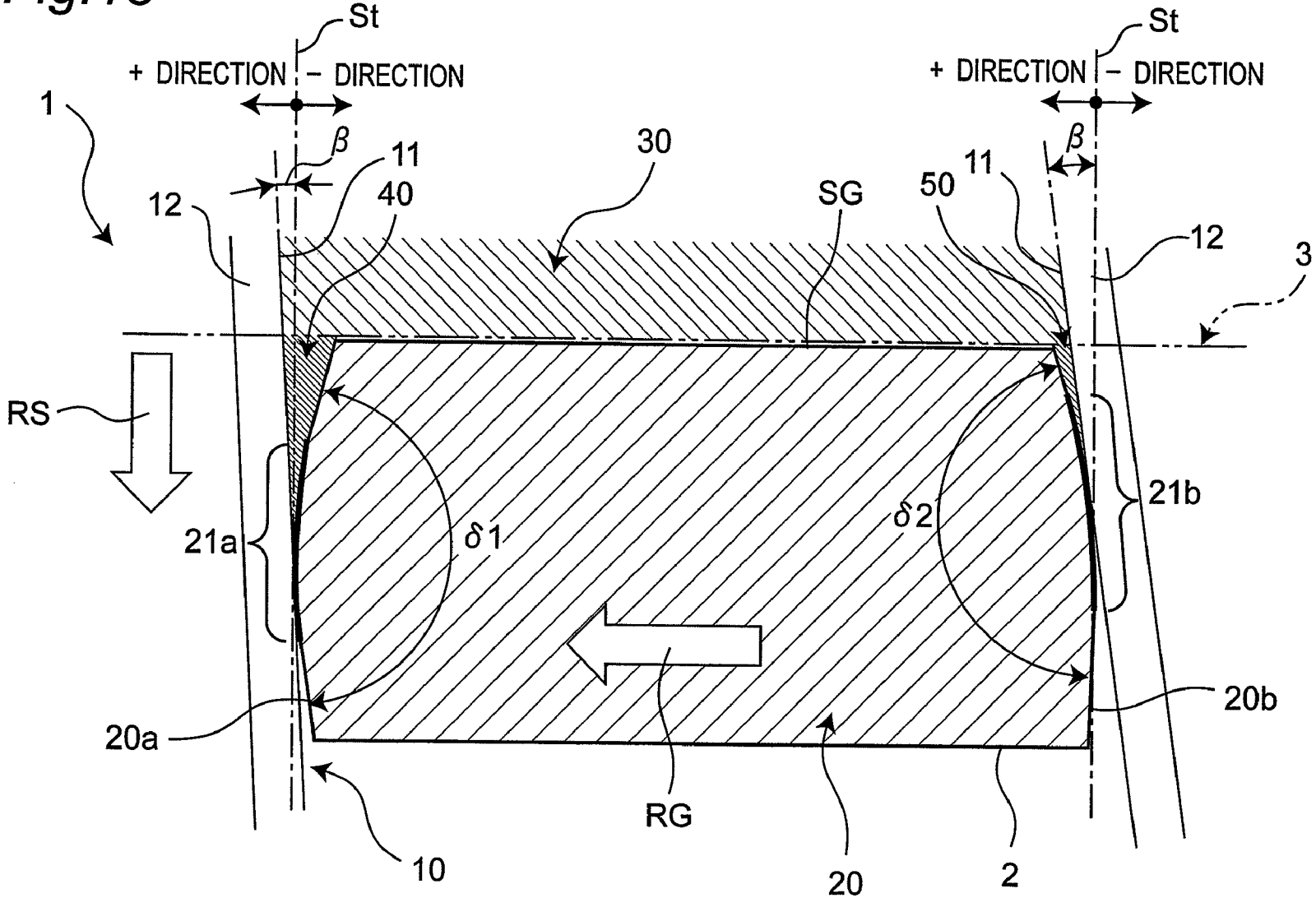
FIG. 13 is an enlarged sectional view of the compressor.

It is to be noted here that the screw rotor groove inclination angle β, as shown in FIG. 13, refers to an angle β formed by the side face 11 of a groove portion 10 of the screw rotor 1 against a plane St which orthogonally intersects with the rotational direction (indicated by an arrow RG) of the gate rotor 2 (i.e. a circumferential direction of the gate rotor 2) in a contact portion with the side face 11 of the groove portion 10 of the screw rotor 1. In addition, with the plane St taken as a reference, the screw rotor groove inclination angle β is expressed in positive values (+ direction) on the gate rotor rotational direction (arrow RG direction) side, and in negative values (− direction) on the side opposite to the gate rotor rotational direction (arrow RG direction).

Figure 5:
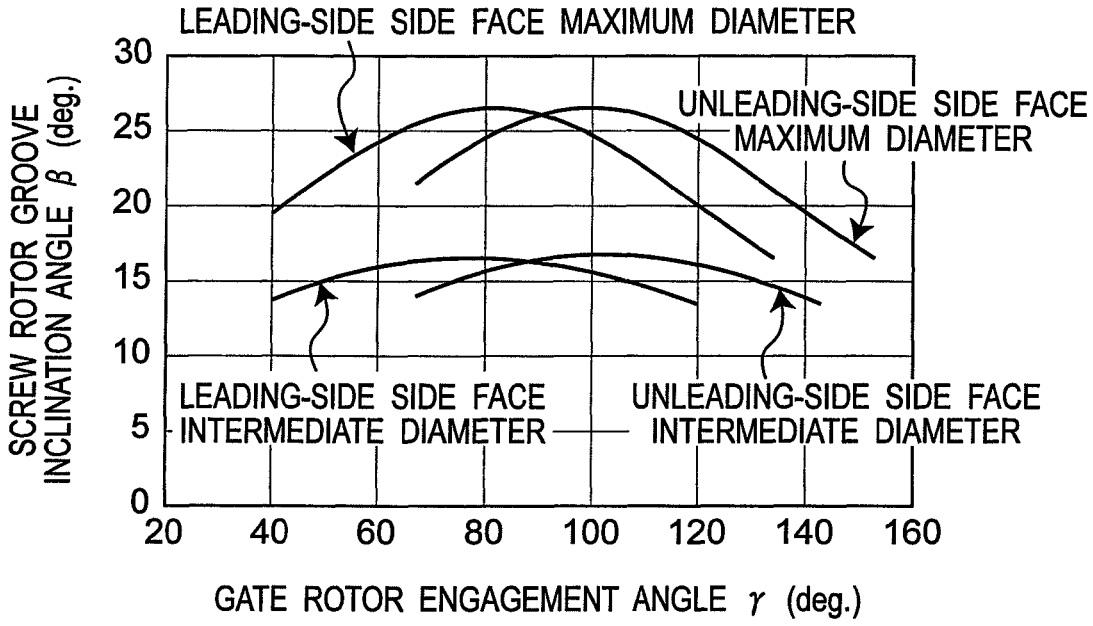
FIG. 5 is a graph showing a relationship between a gate rotor engagement angle $\gamma$ and a screw rotor groove inclination angle $\beta$under the condition that a gate-rotor center axis inclination angle $\alpha$ is 0°, with three screw rotor groove portions and twelve gate rotor tooth portions provided.

FIG. 5 shows a chart when the inclination angle α of the gate rotor center axis 2*a* is 0°, plotting variation widths of the screw rotor groove inclination angle β with respect to engagement maximum diameters and intermediate diameters of the gate rotor 2 in the leading-side side face 20*a* and the unleading-side side face 20*b*, respectively.

Figure 6:
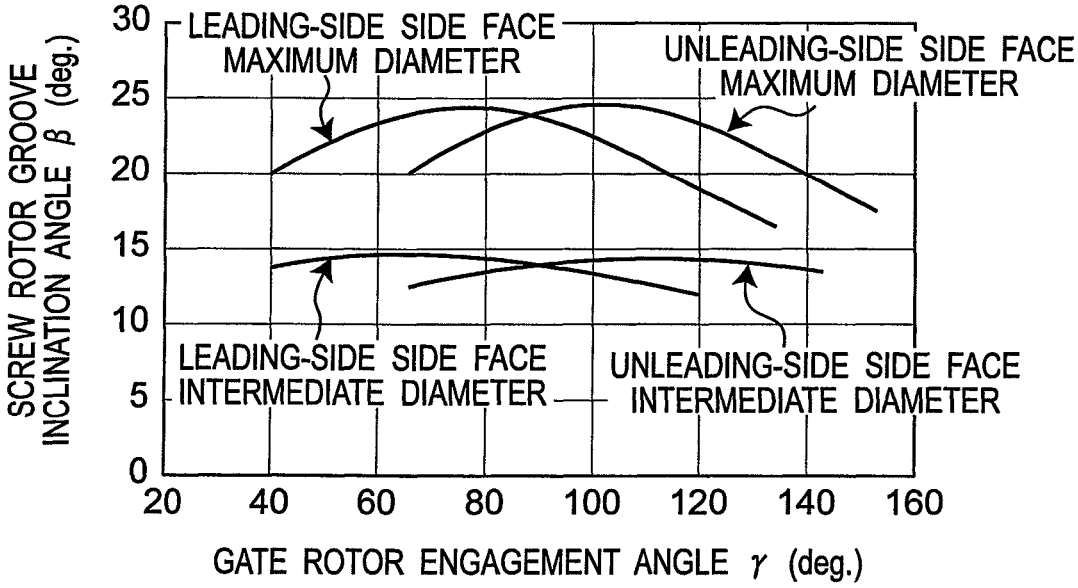
FIG. 6 is a graph showing a relationship between a gate rotor engagement angle $\gamma$ and a screw rotor groove inclination angle $\beta$ under the condition that a gate-rotor center axis inclination angle $\alpha$ is 2.5°, with three screw rotor groove portions and twelve gate rotor tooth portions provided.

FIG. 6 shows a chart when the inclination angle α of the gate rotor center axis 2*a* is 2.5°, where variation widths of the screw rotor groove inclination angle β are smaller than those of the screw rotor groove inclination angle β shown in FIG. 5.

Figure 7:
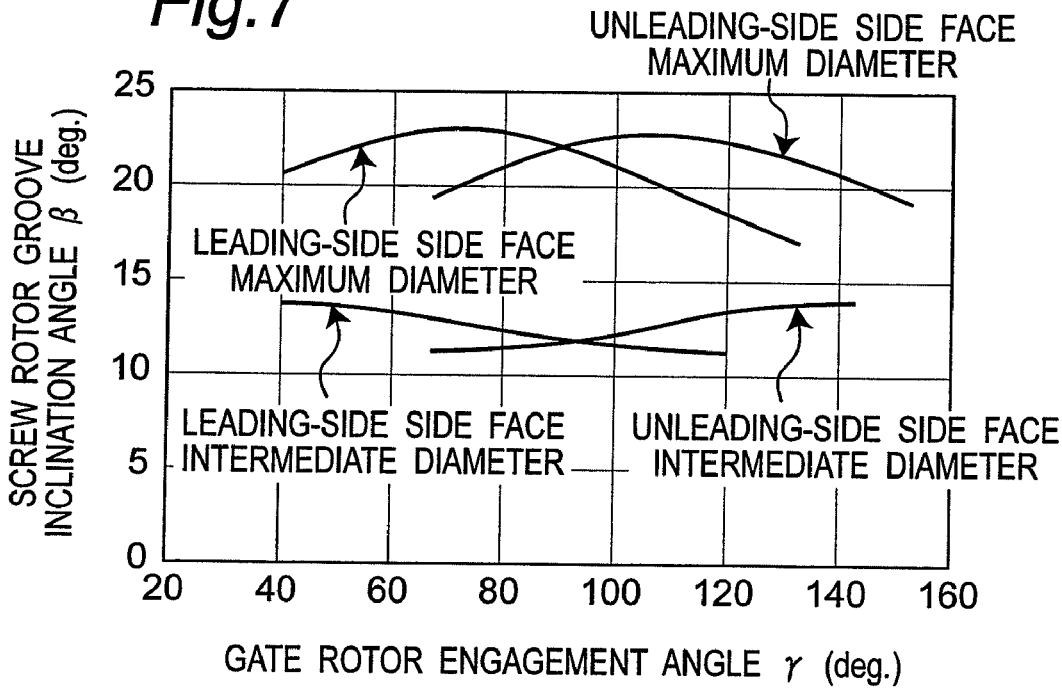
FIG. 7 is a graph showing a relationship between a gate rotor engagement angle $\gamma$ and a screw rotor groove inclination angle $\beta$ under the condition that a gate-rotor center axis inclination angle $\alpha$ is 5°, with three screw rotor groove portions and twelve gate rotor tooth portions provided.

FIG. 7 shows a chart when the inclination angle of the gate rotor center axis 2*a* is 5°, where as the gate rotor engagement angle γ becomes larger, the screw rotor groove inclination angle β of the leading-side side face 20*a* becomes smaller while the screw rotor groove inclination angle β of the unleading-side side face 20*b* becomes larger, thus allowing the blow hole to become smaller.

Figure 8:
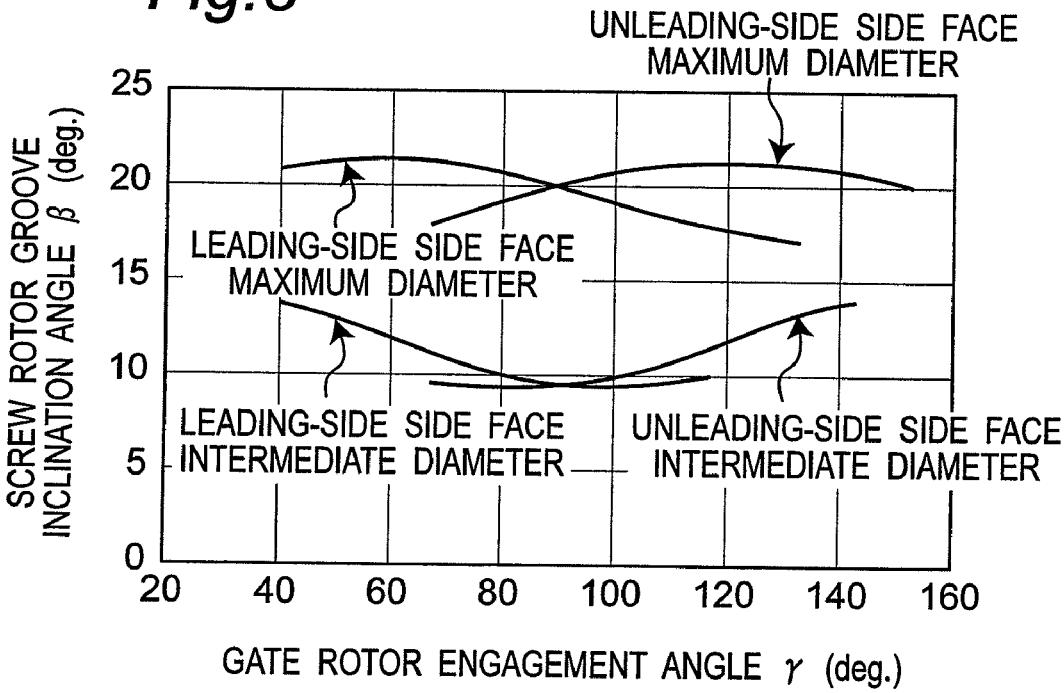
FIG. 8 is a graph showing a relationship between a gate rotor engagement angle $\gamma$ and a screw rotor groove inclination angle $\beta$ under the condition that a gate-rotor center axis inclination angle $\alpha$ is 7.5°, with three screw rotor groove portions and twelve gate rotor tooth portions provided.

FIG. 8 shows a chart when the inclination angle of the gate rotor center axis 2*a* is 7.5°, where as the gate rotor engagement angle γ becomes larger, the screw rotor groove inclination angle β of the leading-side side face 20*a* becomes noticeably smaller in comparison to FIG. 7, while the screw rotor groove inclination angle β of the unleading-side side face 20*b* becomes noticeably larger in comparison to FIG. 7, thus allowing the blow hole to become even smaller.

Next, FIGS. 9 to 12 show relationships between the gate rotor engagement angle γ (see FIG. 4) and the screw rotor groove inclination angle β when the inclination angle α of the gate rotor center axis 2*a* (see FIG. 2) is changed as 0°, 5°, 10° and 15°, plotting those concerning engagement maximum diameters and intermediate diameters (see FIG. 4) of the gate rotor 2 with respect to the leading-side side face 20*a* and the unleading-side side face 20*b* (see FIG. 4), respectively. In this calculation example, the number of the groove portions 10 of the screw rotor 1 is six, and the number of the tooth portions 20 of the gate rotor 2 is twelve.

Figure 9:
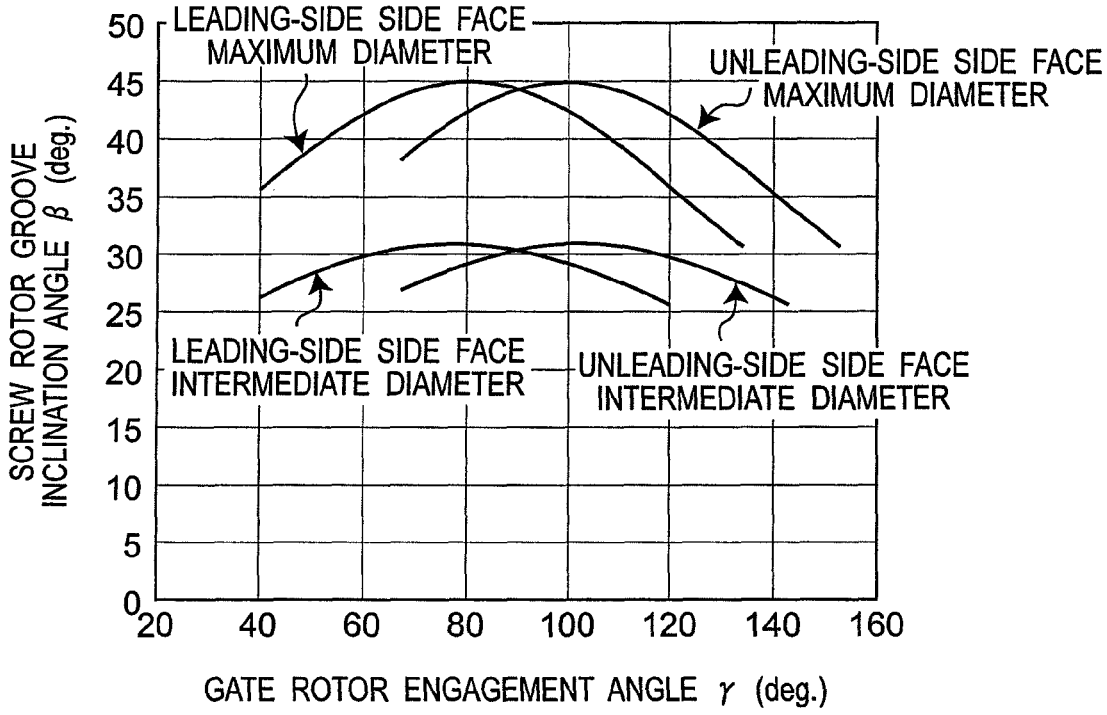
FIG. 9 is a graph showing a relationship between a gate rotor engagement angle $\gamma$ and a screw rotor groove inclination angle $\beta$ under the condition that a gate-rotor center axis inclination angle $\alpha$ is 0°, with six screw rotor groove portions and twelve gate rotor tooth portions provided.

FIG. 9 shows a chart when the inclination angle α of the gate rotor center axis 2*a* is 0°, where the screw rotor groove inclination angle β shows larger variation widths of the engagement maximum diameters and intermediate diameters of the gate rotor 2 with respect to the leading-side side face 20*a* and the unleading-side side face 20*b*, respectively.

Figure 10:
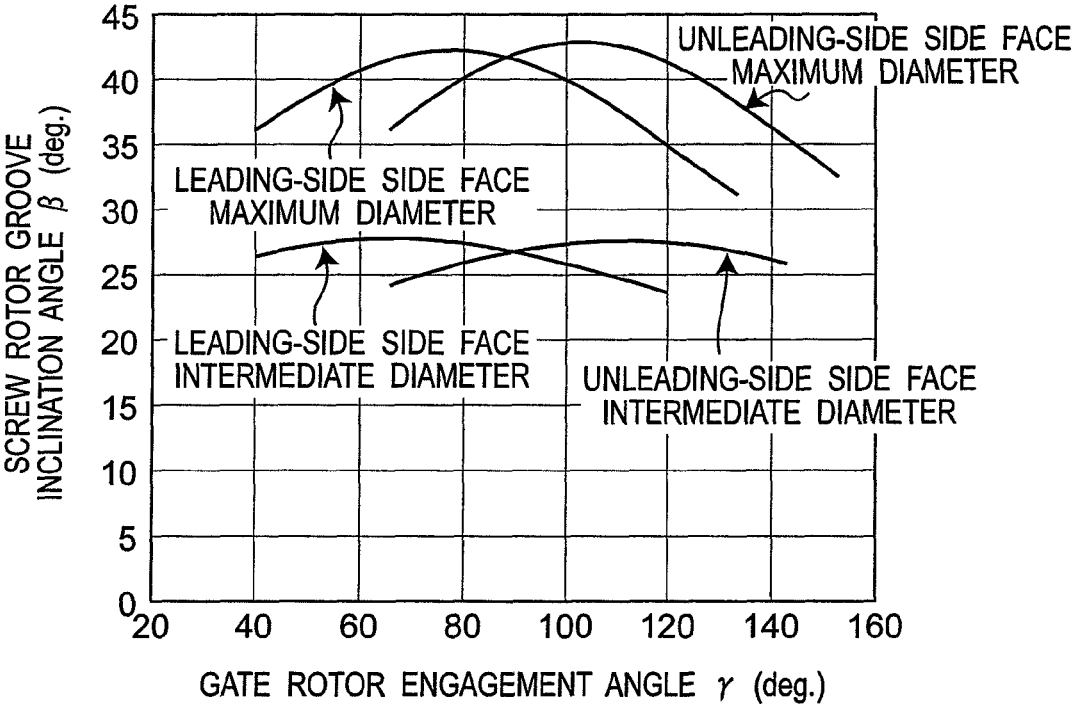
FIG. 10 is a graph showing a relationship between a gate rotor engagement angle $\gamma$ and a screw rotor groove inclination angle $\beta$ under the condition that a gate-rotor center axis inclination angle $\alpha$ is 5°, with six screw rotor groove portions and twelve gate rotor tooth portions provided.

FIG. 10 shows a chart when the inclination angle α of the gate rotor center axis 2*a* is 5°, where variation widths of the screw rotor groove inclination angle β are smaller than those of the screw rotor groove inclination angle β shown in FIG. 9.

Figure 11:
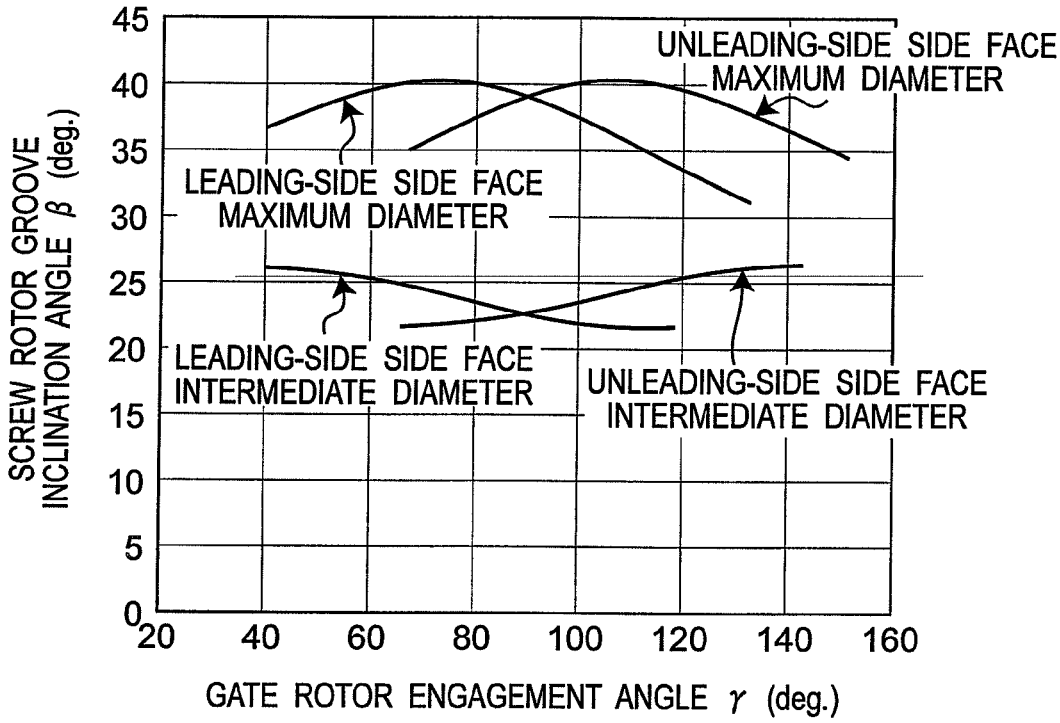
FIG. 11 is a graph showing a relationship between a gate rotor engagement angle $\gamma$ and a screw rotor groove inclination angle $\beta$ under the condition that a gate-rotor center axis inclination angle $\alpha$ is 10°, with six screw rotor groove portions and twelve gate rotor tooth portions provided.

FIG. 11 shows a chart when the inclination angle of the gate rotor center axis 2*a* is 10°, where as the gate rotor engagement angle γ becomes larger, the screw rotor groove inclination angle β of the leading-side side face 20*a* becomes smaller while the screw rotor groove inclination angle β of the unleading-side side face 20*b* becomes larger, thus allowing the blow hole to become smaller.

Figure 12:
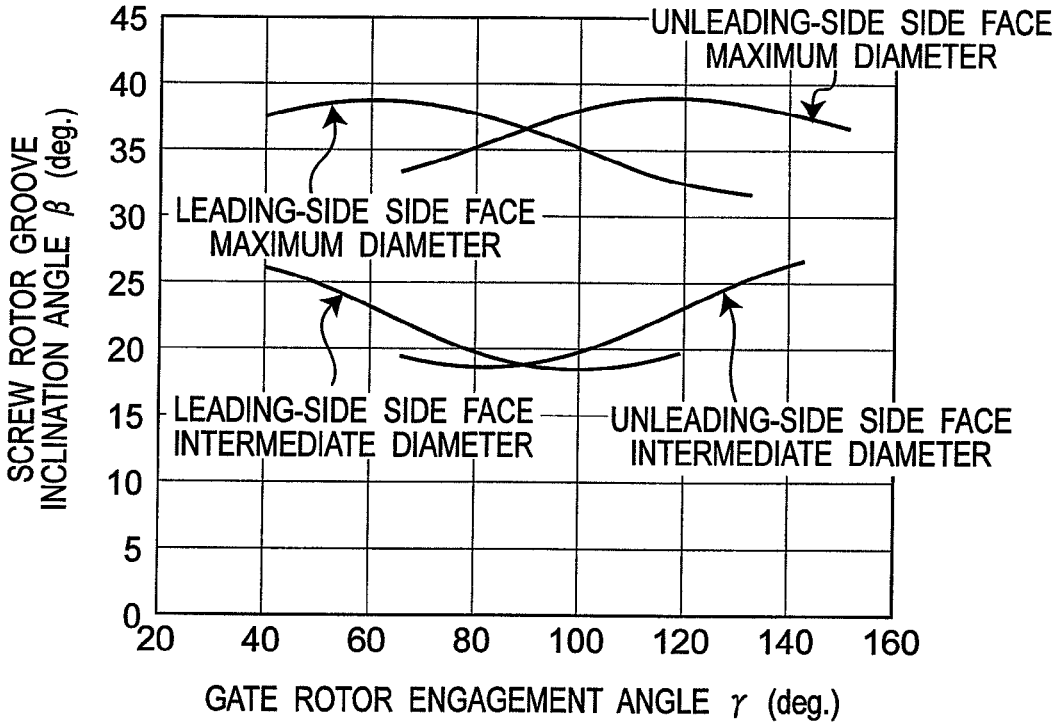
FIG. 12 is a graph showing a relationship between a gate rotor engagement angle $\gamma$ and a screw rotor groove inclination angle $\beta$ under the condition that a gate-rotor center axis inclination angle $\alpha$ is 15°, with six screw rotor groove portions and twelve gate rotor tooth portions provided.

FIG. 12 shows a chart when the inclination angle of the gate rotor center axis 2*a* is 15°, where as the gate rotor engagement angle γ becomes larger, the screw rotor groove inclination angle β of the leading-side side face 20*a* becomes noticeably smaller in comparison to FIG. 11, while the screw rotor groove inclination angle β of the unleading-side side face 20*b* becomes noticeably larger in comparison to FIG. 11, thus allowing the blow hole to become even smaller.

As shown in the enlarged sectional view of FIG. 13, seal portions 21*a*, 21*b* of the tooth portion 20 of the gate rotor 2 to be in contact with the groove portion 10 of the screw rotor 1 are formed each into a curved-surface shape.

That is, a leading-side seal portion 21*a* is formed at the leading-side side face 20*a* of the tooth portion 20, while an unleading-side seal portion 21*b* is formed at the unleading-side side face 20*b* of the tooth portion 20.

The screw rotor 1 moves along a downward-pointed arrow direction, while the gate rotor 2 moves along a leftward-pointed arrow direction.

At engagement portions between the groove portion 10 of the screw rotor 1 and the tooth portion 20 of the gate rotor 2, blow holes (leak clearances) 40, 50 shown by hatching are present.

More specifically, a leading-side blow hole 40 (shown by hatching) is present on an upstream side (compression chamber 30 side shown by hatching) of the leading-side seal portion 21*a* in the moving direction of the screw rotor 1, while an unleading-side blow hole 50 (shown by hatching) is present on an upstream side (the compression chamber 30 side) of the unleading-side seal portion 21*b* in the moving direction of the screw rotor 1.

The fluid compressed in the compression chamber 30 passes through the blow holes 40, 50 to leak outside the casing 3 (shown by imaginary line).

Figure 14:
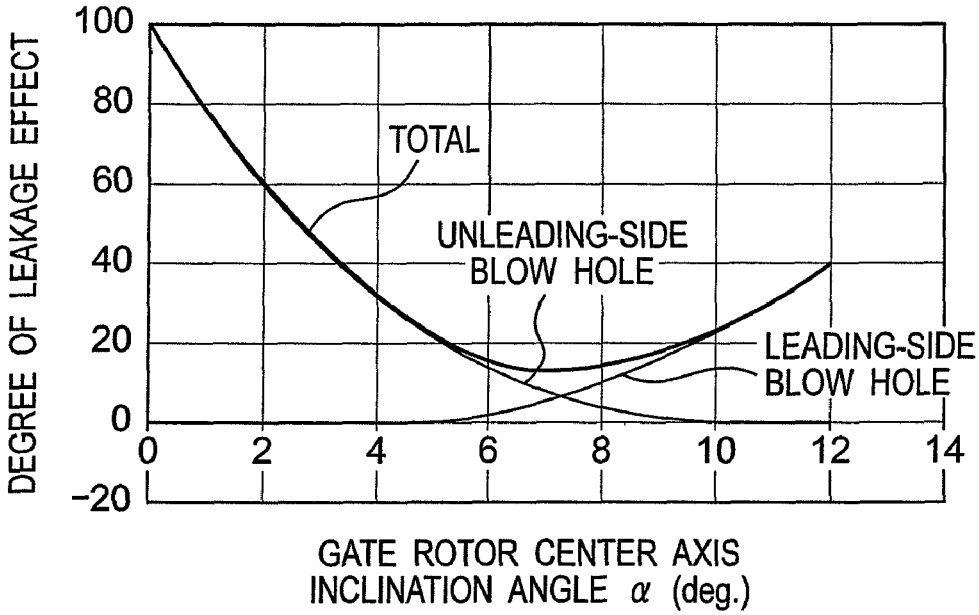
FIG. 14 is a graph showing a relationship between the gate-rotor center axis inclination angle $\alpha$ and the degree of leakage effect with three screw rotor groove portions and twelve gate rotor tooth portions provided.
Figure 15:
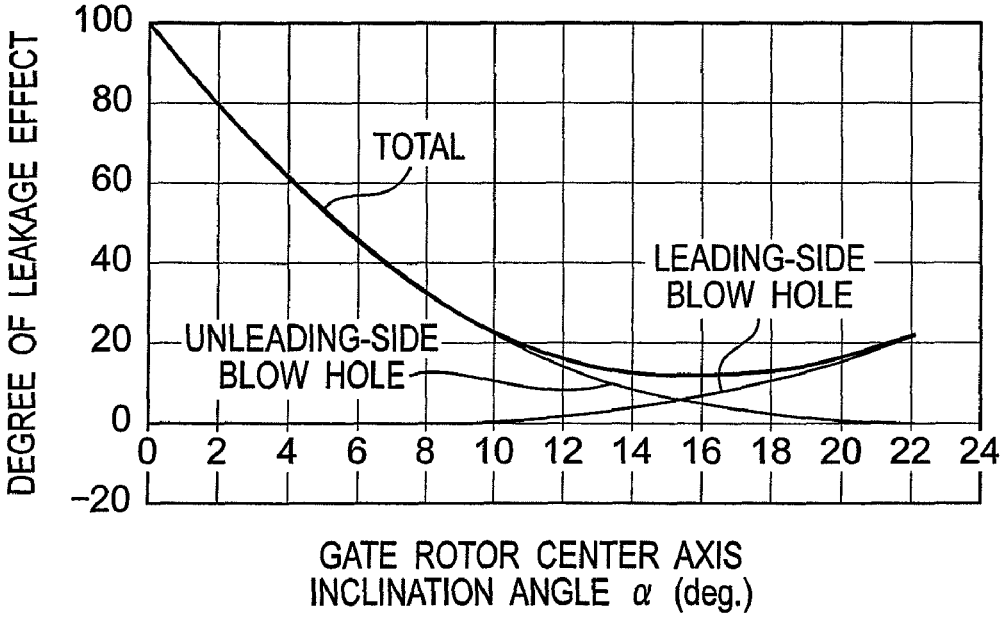
FIG. 15 is a graph showing a relationship between the gate-rotor center axis inclination angle α and the degree of leakage effect with six screw rotor groove portions and twelve gate rotor tooth portions provided.

Then, FIGS. 14 and 15 show relationships between the inclination angle α of the gate rotor center axis 2*a* (see FIG. 2) and the degree of leakage effect, plotting a degree of leakage effect of the leading-side blow hole 40 (see FIG. 13), a degree of leakage effect of the unleading-side blow hole 50 (see FIG. 13), and a total of degrees of leakage effects of the leading-side blow hole 40 and the unleading-side blow hole 50. It is to be noted here that the term, degree of leakage effect, refers to a ratio obtained by correcting areas of the leading-side blow hole 40 and the unleading-side blow hole 50 to leak amounts, respectively, and by assuming that the degree of leakage effect is 100 when the inclination angle α of the gate rotor center axis 2*a* is 0° (as in the conventional case).

FIG. 14 shows degrees of leakage effect when the number of groove portions 10 of the screw rotor 1 is three and the number of tooth portions 20 of the gate rotor 2 is twelve. When the inclination angle α of the gate rotor center axis 2*a* is around 7°, the degree of leakage effect comes to a minimum, so that the compression efficiency is improved.

FIG. 15 shows degrees of leakage effect when the number of groove portions 10 of the screw rotor 1 is six and the number of tooth portions 20 of the gate rotor 2 is twelve. When the inclination angle α of the gate rotor center axis 2*a* is around 16°, the degree of leakage effect comes to a minimum, so that the compression efficiency is improved.

According to the compressor of the above-described constitution, since the gate rotor center axis 2*a* passes through the intersection point P among the first plane S1, the second plane S2 and the third plane S3 and moreover is inclined against the second plane S2 toward the same side as the groove portions 10 of the screw rotor 1 as viewed in the direction perpendicular to the third plane S3, side faces of a groove portion 10 of the screw rotor 1 to be in contact with the tooth portion 20 of the gate rotor 2 can be set at approximately 90° against the rotational direction (indicated by arrow RG) of the tooth portion 20 of the gate rotor 2 to be in contact with the side faces 11 of the groove portion 10 of the screw rotor 1 (i.e. against the circumferential direction of the gate rotor 2) as shown in FIG. 13. Thus, the variation width of the screw rotor groove inclination angle β can be reduced.

In other words, the variation width of the inclination angle of the side faces 11 of the groove portion 10 of the screw rotor 1 to be in contact with the tooth portion 20 of the gate rotor 2, the inclination being against the circumferential direction of the gate rotor 2 and the variation width measuring from axial one end of the screw rotor 1 to the other end of the screw rotor 1, is set smaller, as compared with the variation width resulting when the gate rotor center axis 2*a* is parallel to the second plane S2 at which the gate rotor center axis 2*a* orthogonally intersects with the screw rotor center axis 1*a*. In addition, the term, "circumferential direction of the gate rotor 2," can be reworded as the rotational direction of the tooth portion 20 of the gate rotor 2 to be in contact with the side faces 11 of the groove portion 10 of the screw rotor 1. Also, the term, "variation width of the screw rotor 1 from one axial end to the other axial end," refers to a variation width of the inclination angles of all the groove portions 10 from the one axial end to the other axial end of the screw rotor 1 to be concurrently in contact with the tooth portions 20 of the gate rotor 2.

Therefore, edge angles δ1, δ2 (see FIG. 13) of the seal portions of the gate rotor 2 to be engaged with the side faces of the groove portions 10 of the screw rotor 1 can be made obtuse, so that the blow holes (leak clearances) present at engagement portions between the groove portions 10 of the screw rotor 1 and the tooth portions 20 of the gate rotor 2 can be made smaller. Thus, the compression efficiency can be improved. Besides, wear of the seal portions of the gate rotor 2 can be reduced, allowing an improvement in durability to be achieved.

In consequence, in the present invention, it has been found that in the CP-type single screw compressor, the angle of side faces of the groove portions 10 of the screw rotor 1 to be in contact with the tooth portions 20 of the gate rotor 2 is varied by making the gate rotor center axis 2*a* inclined against a plane orthogonally intersecting with the screw rotor center axis 1*a*.

Preferably, the inclination angle α of the gate rotor center axis 2*a* is 5°-30°. In this case, the variation width of the screw rotor groove inclination angle β can be made even smaller.

Also, since the seal portions 21*a*, 21*b* of the tooth portions 20 of the gate rotor 2 to be in contact with the groove portions 10 of the screw rotor 1 are formed into a curved-surface shape, leaks of the compressed fluid from engagement portions between the tooth portions 20 of the gate rotor 2 and the groove portions 10 of the screw rotor 1 can be reduced, so that the compression efficiency can be improved. Besides, wear resistance of the engagement portions between the tooth portions 20 of the gate rotor 2 and the groove portions 10 of the screw rotor 1 can be improved.

In other words, since the variation width of the screw rotor groove inclination angle β can be made small, the seal portions 21*a*, 21*b* of the gate rotor 2 can be formed into a curved-surface shape. More specifically, maximum and minimum values of the inclination angle can be fulfilled by machining the groove portions 10 of the screw rotor 1 with an end mill and by forming the seal portions 21*a*, 21*b* of the tooth portions 20 of the gate rotor 2 into a curved-surface shape with an end mill.

The present invention is not limited to the above-described embodiment. For example, the number of the gate rotors 2 may be freely increased or decreased. Further, the seal portions 21*a*, 21*b* of the tooth portions 20 of the gate rotor 2 to be in contact with the groove portions 10 of the screw rotor 1 may also be formed into an acute-angle shape.

What is claimed is:

1. A compressor comprising:

a cylindrical-shaped screw rotor arranged to rotate about a screw rotor center axis, the screw rotor having an outer circumferential surface with at least one groove portion extending spirally about the screw rotor center axis; and a gate rotor arranged to rotate about a gate rotor center axis, the gate rotor having a plurality of tooth portions arrayed circumferentially on an outer circumference of the gate rotor, the groove portion of the screw rotor and the tooth portions of the gate rotor being engaged with each other to form a compression chamber, the screw rotor and the gate rotor being arranged such that a first plane contains the screw rotor center axis, a second plane intersects orthogonally with the screw rotor center axis and further intersects with the groove portion of the screw rotor, and a third plane intersects orthogonally with the first plane and the second plane and is separate from the groove portion of the screw rotor, and wherein the gate rotor center axis passes through an intersection point of the first plane, the second plane and the third plane, the gate rotor center axis is inclined by about 7 degrees relative to the second plane toward a same side as the groove portion of the screw rotor, as viewed in a direction perpendicular to the third plane, the at least one groove portion of the screw rotor includes three groove portions and the tooth portions of the gate rotor are twelve in number, and the tooth portions of the gate rotor have seal portions in contact with the groove portions of the screw rotor, and the seal portions are formed into a curved-surface shape.

2. A compressor comprising:

a cylindrical-shaped screw rotor arranged to rotate about a screw rotor center axis, the screw rotor having an outer circumferential surface with at least one groove portion extending spirally about the screw rotor center axis; and a gate rotor arranged to rotate about a gate rotor center axis, the gate rotor having a plurality of tooth portions arrayed circumferentially on an outer circumference of the gate rotor, the groove portion of the screw rotor and the tooth portions of the gate rotor being engaged with each other to form a compression chamber, the screw rotor and the gate rotor being arranged such that a first plane contains the screw rotor center axis, a second plane intersects orthogonally with the screw rotor center axis and further intersects with the groove portion of the screw rotor, and a third plane intersects orthogonally with the first plane and the second plane and is separate from the groove portion of the screw rotor, the gate rotor center axis passing through an intersection point of the first plane, the second plane and the third plane, and the gate rotor center axis being inclined by about 16 degrees relative to the second plane toward a same side as the groove portion of the screw rotor, as viewed in a direction perpendicular to the third plane, the at least one groove portion of the screw rotor includes six groove portions and the tooth portions of the gate rotor are twelve in number, and the tooth portions of the gate rotor have seal portions in contact with the groove portions of the screw rotor, and the seal portions are formed into a curved-surface shape.

* * * * *